United States Patent [19]

Maruyama et al.

[11] 4,354,138

[45] Oct. 12, 1982

[54] TELEVISION CAMERA TUBE WITH ELECTROSTATIC FOCUSING AND MAGNETIC DEFLECTION

[75] Inventors: Masanori Maruyama, Kokubunji; Masashi Mizushima, Shizuoka; Masakazu Fukushima, Kokubunji; Satoru Miyamoto; Hideyuki Sakai, both of Mobara, all of Japan

[73] Assignee: Hitachi, Ltd., Tokyo, Japan

[21] Appl. No.: 192,995

[22] Filed: Oct. 2, 1980

[30] Foreign Application Priority Data

Oct. 3, 1979 [JP] Japan ..... 54/126843

[51] Int. Cl.[3] ..... H01J 31/00; H01J 31/26

[52] U.S. Cl. ..... 313/440; 313/382; 313/389

[58] Field of Search ..... 313/389, 382, 440, 384, 313/365

[56] References Cited

U.S. PATENT DOCUMENTS

| | | | |
|---|---|---|---|
| 2,533,073 | 12/1950 | Weimer | 313/382 |
| 3,801,855 | 4/1974 | Gerlach | 313/389 |
| 4,268,777 | 5/1981 | Roosmalen | 313/389 X |
| 4,271,373 | 6/1981 | Himmelbauer et al. | 313/389 X |

FOREIGN PATENT DOCUMENTS

| | | | |
|---|---|---|---|
| 2315784 | 10/1973 | Fed. Rep. of Germany | 313/389 |
| 2533744 | 12/1976 | Fed. Rep. of Germany | 313/382 |
| 53-86053 | 12/1978 | Japan | 313/382 |

OTHER PUBLICATIONS

"Saticon and its application to small-sized color TV cameras," Ninomiya; NHK Technical Monograph No. 25, p. 3–39, Mar. 1976.

*Primary Examiner*—Robert Segal
*Attorney, Agent, or Firm*—Craig & Antonelli

[57] ABSTRACT

A television camera tube with electrostatic focusing and magnetic deflection comprises in an cylindrical envelope a beam current control, a main lens section and a sixth grid in the form of a mesh electrode. The beam current control section includes a cathode, a first grid and a second grid with an electron beam limiting diaphragm in this order. The main lens section includes third, fourth and fifth grids in the form of cylindrical electrodes disposed in this order. Around the cylindrical envelope is mounted a magnetic deflection coil whose length along the envelope axis is 0.18 to 0.40 times the distance from the beam limiting diaphragm to the mesh electrode.

3 Claims, 5 Drawing Figures

TELEVISION CAMERA TUBE WITH ELECTROSTATIC FOCUSING AND MAGNETIC DEFLECTION

This invention relates to an improvement on a television camera tube with electrostatic focusing and magnetic deflection.

Figure 1:
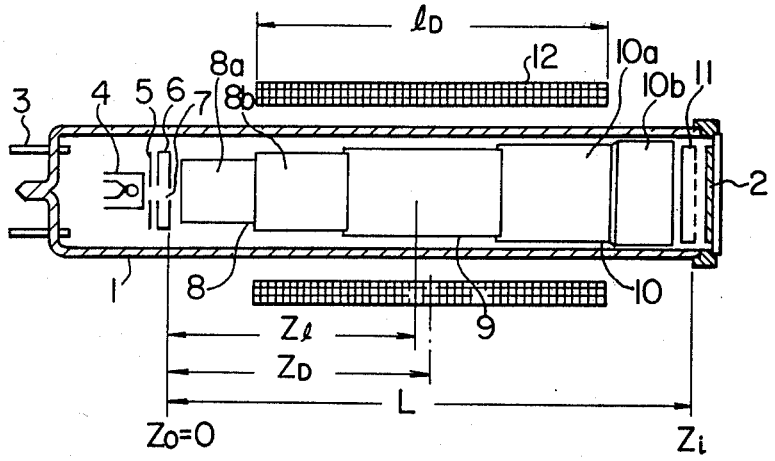

First, the structure and the operation of a conventional television camera tube with electrostatic focusing and magnetic deflection will be briefly described. FIG. 1 shows in longtitudinal section the schematic structure of such a camera tube.

In FIG. 1, reference numeral 1 is a cylindrical glass envelope. A photoconductive target 2 is provided at the front end of the envelope 1, a plurality of lead pins 3 are provided through the rear end of the envelope 1, and high vacuum is maintained in the envelope 1. In this envelope are concentrically arranged various electrodes. A cathode 4 emits an electron beam and a first and a second grids 5 and 6 serve to control the electron current, the converging angle and the cross-sectional area or diameter of the electron beam. A small aperture (electron beam limiting diaphragm) 7 is disposed at the side of the second grid 6 nearer to the photoconductive target 2 so as to provide a narrowly defined electron beam. The cathode 4, the first grid 5, the second grid 6 and the electron beam limiting aperture 7 constitute a beam current control section of the electron gun. Third, fourth (middle) and fifth grids 8, 9 and 10 are each in the form of a cylindrical electrode and these grids 8, 9 and 10 constitute a main lens (focusing lens) section which focuses the diverging electron beam through the aperture 7 of the second grid 6 from the beam current control onto the surface of the photoconductive target 2 with a small spot. A sixth grid 11 in the form of a mesh electrode is interposed between the fifth grid 10 and the photoconductive target 2. The fifth and sixth grids 10 and 11 make up a collimation lens for causing the electron beam to always hit the photoconductive target perpendicularly. An electromagnetic deflection coil 12 for deflecting the electron beam is mounted around the envelope 1. In this camera tube having such a structure as described above, the electron beam emitted from the beam current control section is focused on the photoconductive target 2 through the combined function of the focusing lens section and the sixth grid or mesh electrode 11 while the beam is deflected by the electromagnetic deflection coil 12, whereby a video signal is obtained through the scanning of the target 2 by the beam. Namely, when an optical image is formed on the surface of the photoconductive target 2, there is developed a distribution of potential corresponding to the optical image on the surface. Upon incidence of the electron beam into the surface, the potential at every point of incidence is reduced to about zero volt. At this time, discharge current flows through the electrostatic capacitance of the target 2 and this current is taken out as a video signal.

The main lens section and the electromagnetic deflection coil assembly of a typical example of a conventional camera tube such as, for example, a $\frac{2}{3}$ inch type camera tube have the following dimensions. The third grid 8 is a stepped cylindrical electrode which has interconnected lower and upper cylindrical portions 8*a* and 8*b* whose inner diameters are different. The length of the stepped cylindrical electrode is about 25.4 mm. The inner diameter of the lower cylindrical portion 8*a* is about 7.6 mm and that of the upper cylindrical portion 8*b* about 9.6 mm. The fourth grid 9 is a cylindrical electrode, about 12.0 mm long, with its inner diameter of 10.4 mm. The fifth grid 10 is a stepped cylindrical electrode which has interconnected lower and upper cylindrical portions 10*a* and 10*b* whose inner diameters are different. The length of the stepped cylindrical electrode is about 24.4 mm. The inner diameter of the lower cylindrical portion 10*a* is about 11.6 mm and that of the upper cylindrical portion about 12.4 mm. The length $l_D$ of the deflection coil 12 in the direction of the axis of the envelope 1 (winding width) is about 28.0–30.0 mm. The total length L of the main lens section, ranging from the electron beam limiting diaphragm 7 to the mesh electrode 11, is about 67 mm. The distance $Z_l$ from the diaphragm 7 to the middle point of the fourth grid 9 in its axial length (hereafter referred to as lens center distance) is about 34.4 mm. The distance $Z_D$ from the aperture 7 to the point where the magnetic deflection field assumes its maximum value in its distribution along the envelope axis (hereafter referred to as deflection center distance), is about 37.5 mm. This maximum value is reached at the middle point of the deflection coil 12 in the axial direction of the envelope. Thus, according to the conventional design, it is customary that the deflection center distance $Z_D$ is made equal to the lens center distance $Z_l$ or that the former distance $Z_D$ is slightly longer than the latter distance $Z_l$.

Voltages applied to these electrodes are as follows with the potential at the cathode 4 taken as 0 V: −150–0 V to the first grid 5; 200–500 V to the second grid 6; 500 V, 60–90 V, 300 V and 500 V respectively to the cylindrical electrodes 8, 9, 10 and the mesh electrode 11 for their low-voltage operation; 1400 V, 180–210 V, 770 V and 1400 V respectively to the cylindrical electrodes 8, 9, 10 and the mesh electrode 11 for their high-voltage operation; and 30–80 V to the photoconductive target 2.

In general, a television camera tube with electrostatic focusing and magnetic deflection has an advantage over a television camera tube with magnetic focusing and magnetic deflection in that it is small in size, light in weight and consumes less electric power, but it also has drawbacks of relatively low resolution and of degraded resolution especially in the corners of the picture.

The resolution power is one of the important factors which estimate the performance of a camera tube. The resolution of a camera tube depends closely on the diameter of the spot of the electron beam on the photoconductive target and the smaller is the spot diameter of the electron beam, the more improved is the resolution. However, the minimum diameter attainable of a focused electron beam depends on the distribution of initial velocities of electrons emitted from thermionic cathode (i.e. the initial-velocity spread of thermionic emission), the space charge effect and the spherical aberration of the focusing lens. Especially, the initial-velocity spread of thermionic emission and the spherical aberration of the main lens have predominant influence on the spot diameter of the beam in the central region of the screen or target. On the other hand, the spot diameter in the corners of the picture or the target is more affected by the third order geometrical aberration caused in deflecting the electron beam than by the previous factors. In order to attain a good resolution, therefore, it is necessary both to minimize the spread of the electron beam due to the initial-velocity spread of thermionic emission and the spherical aberration of the focusing lens to decrease the beam spot diameter in the central region of the image screen and to minimize the spread of the beam due to the third order geometrical aberration to decrease the beam spot diameter in the corner of the picture. In the case of an electro-optical system such as the electrostatic focusing and magnetic deflection camera tube, however, in which the lens region (focusing region) and the magnetic field region (deflection region) coexist, the mathematical treatment of the third order geometrical aberration is so difficult that the spread of the beam due to this aberration cannot be exactly estimated. Therefore, with the constitution of the conventional camera tube, the resolution in the corners of the picture is not necessarily optimal.

It is therefore one object of this invention to provide a camera tube with electrostatic focusing and magnetic deflection in which the resolution in the corners of the picture can be improved without degrading the resolution in he central region of the picture.

This invention has been made on the basis of the fact that the theory of the third order geometrical aberration came to be clarified as a result of the development of that theory in the electron optics of electrostatic focusing and magnetic deflection type. Namely, the relationships between various parameters for defining the structure of a camera tube and the third order geometrical aberration are calculated through computer simulations on the basis of the above theory and the optimal structure for a camera tube can be obtained from the above-derived value of the third order geometrical aberration.

A first embodiment of this invention provides a camera tube with electrostatic focusing and magnetic deflection having a magnetic deflection coil whose length in the direction of the envelope axis is 0.18–0.40 times the distance from the electron beam limiting diaphragm of the beam current control section to the mesh electrode.

A second embodiment of this invention provides a camera tube with electrostatic focusing and magnetic deflection in which the magnetic deflection coil is so arranged in the envelope that the distance from the beam limiting diaphragm to the middle point of the length of the magnetic deflection coil along the envelope axis is greater than 0.56 times the distance between the diaphragm and the mesh electrode and smaller than or equal to 0.7 times the distance between the diaphragm and the mesh electrode.

A third embodiment of this invention provides a camera tube with electrostatic focusing and magnetic deflection in which the distance from the electron beam limiting diaphragm to the middle point of the length along the envelope axis of the middle one of the three cylindrical electrodes is greater than or equal to 0.47 times the distance from the diaphragm to paid mesh electrode and smaller than 0.51 times the distance between the diaphragm and the mesh electrode.

With the camera tube as described above, both the focusing lens region and the deflection magnetic field region are optimally arranged and therefore the spread of the electron beam due to the third order geometrical aberration can be suppressed to a great extent, whereby the resolution in the corners of the picture can be improved.

Figure 2:
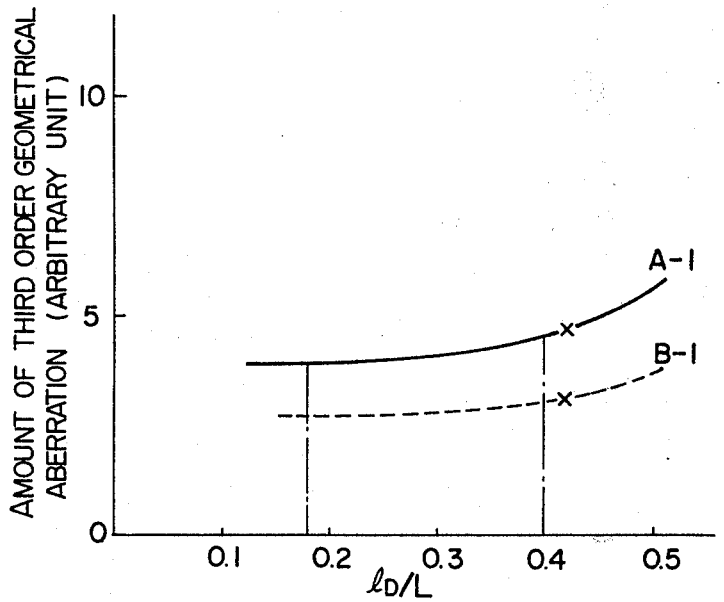
Figure 3:
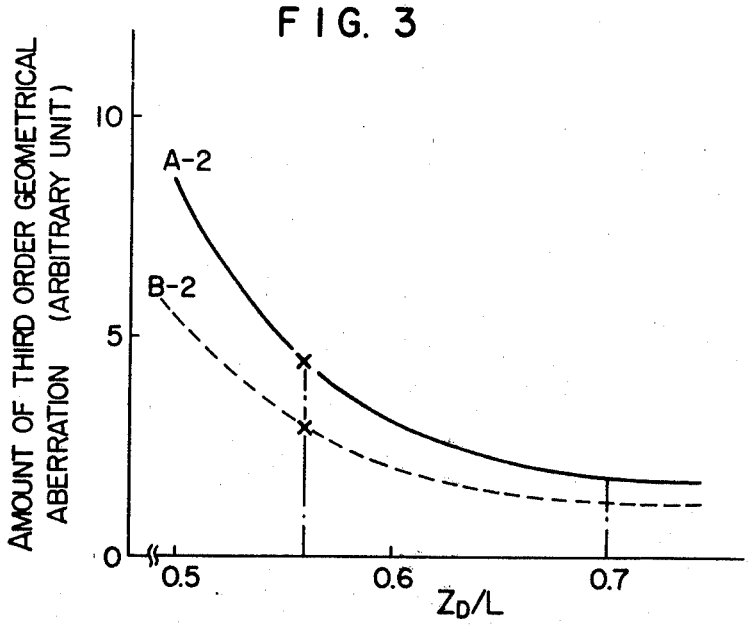
Figure 4:
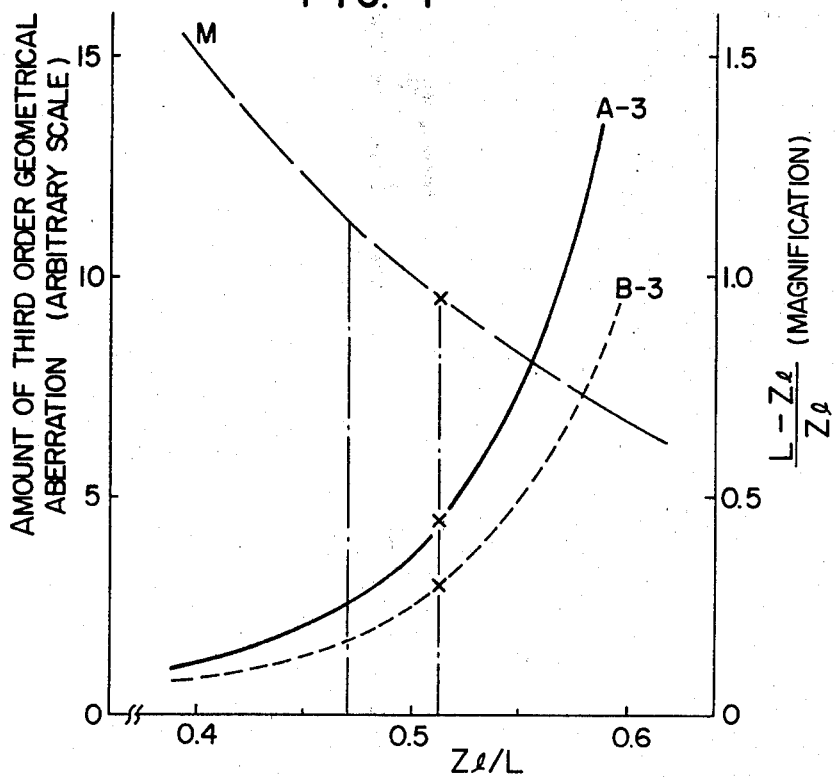
Figure 5:
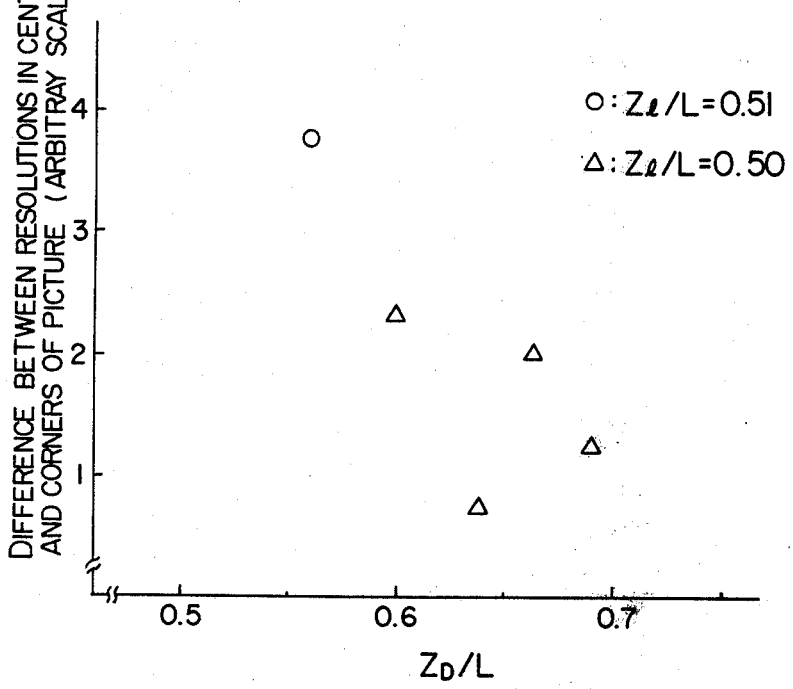

The above-mentioned and other features and objects of this invention will become more apparent by reference to the following description taken in conjunction with the accompanying drawings, in which:

FIG. 1 schematically shows in longitudinal section the structure of a conventional camera tube with electrostatic focusing and magnetical deflection to which this invention is applicable;

FIG. 2 shows graphically the relationship between the third order geometrical aberration and the ratio of the length of the deflection coil to the total length of the main lens section;

FIG. 3 graphically shows the relationship between the third order geometrical aberration and the ratio of the deflection center distance to the total length of the main lens section;

FIG. 4 graphically shows the relationship between the third order geometrical aberration and the ratio of the lens center distance to the total length of the main lens section; and FIG. 5 is a plot of measured amplitude response under various conditions.

The present inventors have derived the third order geometrical aberration coefficients in an electron optics of electrostatic focusing and magnetic deflection type by further developing the theory of the third order geometrical aberration applied to the electron optics of electrostatic focusing and magnetic deflection type. Then, by the use of the thus derived coefficients the inventors have also calculated through computer simulations various third order geometrical aberrations depending on the parameters to properly determine the details of the focusing lens and the deflection magnetic field, such as, for example, the lengths and the diameters of the cylindrical electrodes constituting the focusing lens and the voltages to be applied to the electrodes. As a result, the inventors have found that among the various third order geometrical aberration coefficients the field curvature aberration coefficient has more dominant effect on the spread of electron beam due to the third order geometrical aberration than the astigmatism aberration coefficient, the coma aberation coefficient and the spherical aberration coefficient.

Detailed description will be made below of the above-mentioned field curvature aberration coefficient $K_3$ is given by the following expression (1), provided that it is expressed in the complex coordinate system where the envelope axis is taken as z axis, the horizonal deflection direction as real axis, and the vertical deflection direction as imaginary axis.

$$K_3 = -\frac{1}{32}\left[\frac{k_o}{a'^2C^2}\right]_{zi} \int_{z_o}^{z_i} g[32(a''c'^2 + 2a'c'c'' - jk_o\tfrac{1}{2}ac'D' + jk_oa_5ac) + 2a_1ac^2 + 2a_2c(pac + 2ac' + a'c) + 2a_3(qac^2 + apacc' - 4a'cc' - a''c^2 - 2ac'^2) + 2a_4a'c'^2]dz \quad (1)$$

In the expression (1), $$c(z) = jk_o\left[-a\int_{z_o}^{z_i} Dbdz + b\int_{z_o}^{z_i} Dadz\right],$$

$$k_o(z) = \sqrt{e/2m\phi},$$

$$g(z) = \frac{a}{k_o},\ p(z) = \frac{g'}{g},\ q(z) = \frac{g''}{g},$$

$$a_1(z) = \frac{\phi''}{\phi}\left[2\left(\frac{\phi''}{\phi}\right)^2 - 3\frac{\phi''}{\phi}\right],$$

-continued $$a_2(z) = -2\frac{\phi'}{\phi}\cdot\frac{\phi''}{\phi},$$

$$a_3(z) = \frac{\phi''}{\phi},$$

$$a_4(z) = 8\frac{\phi'}{\phi}, \text{ and}$$

$$a_5(z) = -\frac{1}{8}\cdot\frac{\phi''}{\phi}\cdot D,$$

where $z_o$: the z coordinate of the (axial point) object (the position of the electron beam limiting diaphragm 7), $z_i$: the z coordinate of the image (the position of the mesh electrode 11), a(z): the radius of the paraxial trajectory of an electron emitted with zero radius and an inclination of unity of $z=z_o$, b(z): the radius of the paraxial trajectory of an electron emitted with a radius of unity and zero inclination, $\phi(z)$: the potential at an arbitrary point on the focusing lens along the z axis, D(z): the intensity of the horizontal or vertical deflection magnetic field at an arbitrary point along the z axis, e/m: the ratio of charge to mass of electron (absolute value),

['] : prime indicating a differentiation with respect to z, and j: the imaginary unit.

The close examination of the above expression (1) has revealed that the term including the coefficient $a_5$ predominates over the other terms in the integrand. This means that the field curvature aberration coefficient $K_3$ increases as the product $(\phi''/\phi)D$ of $\phi''/\phi$ indicating the intensity of the focusing electrostatic field and D indicating the intensity of the deflection magnetic field, increases.

The above analysis of the third order geometrical aberration gives a conclusion that in order to suppress the spread of the electron beam due to the third order geometrical aberration and to improve the resolution in the corners of the picture, a camera tube should be fabricated in such a manner that the focusing lens region and the deflection magnetic field region are separated from each other by as great a distance as possible. To do this, there are the three following methods recommended in practice.

(1) To decrease the length (winding width) of the deflection coil 12 along the envelope axis.

(2) To increase the deflection center distance $Z_D$.

(3) To decrease the lens center distance $Z_l$.

These methods will now be described in detail respectively. In the succeeding description, the total length L of the main lens section, the values of the voltages to the respective electrodes and other associated conditions are assumed to be the same as in the conventional camera tube.

First, the above method (1) will be explained. FIG. 2 shows the relationship, obtained through computer simulations, between the amount of the third order geometrical aberration and the ratio $l_D/L$ of the length $l_D$ of the deflection coil along the envelope axis to the total length L of the main lens section, when the deflection center distance $Z_D$ and the lens center distance $Z_l$ are set the same as in the conventional camera tube. In FIG. 2, a curve A-1 corresponds to the above-mentioned low voltage operation and a curve B-1 to the above-mentioned high voltage operation while cross marks X indicate the amounts of the third order geometrical aberration observed in the conventional example ($l_D/L \simeq 0.42$). It is seen from FIG. 2 that as $l_D/L$ decreases, that is, as the length $l_D$ of the deflection coil along the envelope axis decreases, the degree of the third order geometrical aberration decreases. However, if the length $l_D$ is made too small while the electric constants (e.g. inductance and resistance) of the deflection coil are kept substantially constant, then the deflecting action of the deflection coil is adversely affected. Therefore, the lower limit of the value $l_D/L$ may be about 0.18. In this invention, the length $l_D$ is selected such that $0.18 \leqq l_D/L \leqq 0.40$, so as to improve the third order geometrical aberration by more than 5% of that value of the conventional example. For example, if the length $l_D$ is reduced to 60% of that of the conventional example, that is, if $l_D/L$ is made equal to 0.23, then for the low voltage operation the amount of the third order geometrical aberration in this embodiment is decreased by 15% of that of the conventional example.

Next, the second method will now be described. FIG. 3 shows the relationship, obtained through computer simulations, between the amount of the third order geometrical aberration and the ratio $Z_D/L$ of the deflection center distance $Z_D$ to the total length L of the main lens section when the distance $l_D$ of the deflection coil along the envelope axis and the lens center distance $Z_l$ are kept the same as in the conventional example. In FIG. 3, curves A-2 and B-2 respectively represent the amounts of the third order geometrical aberration for the low and high voltage operations while cross marks X give the amount of the third order geometrical aberration in the conventional example ($Z_D/L \simeq 0.56$). It is apparent from FIG. 3 that as $Z_D/L$ increases, that is, as the deflection coil gets nearer to the target, the amount of aberration in question decreases. However, when $Z_D/L$ exceeds 0.7, the deflection angle becomes large. Accordingly, the angle of incidence of the electron beam onto the mesh electrode also becomes large and it is therefore difficult to cast the beam perpendicularly onto the target. It is also apparent from FIG. 3 that too large a value of $Z_D/L$ has little effect on the reduction in the amount of the third order geometrical aberration. On the other hand, the value $Z_D/L$ is about 0.56 in the conventional example, and in this invention the value $Z_D/L$ is set to be within a range such that $0.56 < Z_D/L < 0.70$ so that the amount of the aberration in question in this invention can be reduced to as small a value as about 40% of that in the conventional example. For example, if $Z_D/L$ is set equal to 0.64 by shifting the deflection coil toward the target, the amount of the aberration in question for the low voltage operation in this invention is 51–55% of the corresponding amount in the conventional example. Hence, it is possible to improve the resolution in the corners of the picture to a considerable extent.

Finally, the third method will be explained. FIG. 4 shows the relationship, obtained through computer simulation, among the ratio $Z_l/L$ of the lens center distance $Z_l$ to the total length L of the main lens section, the amount of the third order geometrical aberration and the magnification of the focusing lens, when the length $l_D$ of the deflection coil along the envelope axis and the deflection center distance $Z_D$ are rendered the same as in the conventional example. In FIG. 4, curves A-3 and B-3 represent the amounts of the third order geometrical aberration respectively for the low and high voltage operations, and a curve M gives the magnification of the focusing lens (approximately proportional to $(L-Z_l)/Z_l$) while cross marks X indicate the corresponding quantities in the conventional example ($Z_l/L \simeq 0.51$). As apparent from FIG. 4, the amount of the third order geometrical aberration decreases as the center of the action of the focusing lens approaches the beam limiting diaphragm. However, if $Z_l/L$ is two small, the magnification of the focusing lens becomes very large to increase the spread of the electron beam due to the distribution of the initial-velocity spread of thermionic electrons which is the factor to determine the resolution in the central area of the picture. The increase in the spread of the beam results in the degradation of the resolution in the central area of the picture. Usually, the upper limit of the magnification is about 1.1. Accordingly, the lower limit of $Z_l/L$ is about 0.47. On the other hand, since the value $Z_l/L$ in the conventional example is about 0.51, the value $Z_l/L$ in this invention is chosen to be within an interval such that $0.47 > Z_l/L < 0.51$. As a result, the amount of the third order geometrical aberration can be reduced to about 55% of the corresponding amount in the conventional example. For example, if $Z_l/L$ is set equal to 0.484 by reducing the length of the third grid and by increasing the length of the fifth grid, then the amount of this aberration can be reduced to 36% of that in the conventional example.

In the foregoing description, the embodiments wherein the three methods are separately used, are detailed. However, it is also possible to further improve the resolution in the corners of the picture by the combination of the three methods. FIG. 5 illustrates an example of the combination of some of the three methods described above, representing the measured amplitude response in the high voltage operation of a camera tube fabricated for test by the use of the combination of the above second and third methods. In FIG. 5, the abscissa indicates $Z_D/L$ and the ordinate represents the difference (an arbitrary scale) between the resolutions in the central area and the corners of the picture. In the figure, a circle o represents the measured difference in the conventional camera tube and triangles Δ give the measured differences in a camera tube according to this invention. In the case of the conventional camera tube, $Z_l/L \simeq 0.51$ and $Z_D/L \simeq 0.56$, as described above. In this embodiment of the present invention, $Z_l/L$ is set equal to 0.50 by shifting the center of the action of the focusing lens toward the object (the beam limiting diaphragm) while $Z_D/L$ is set equal to 0.6 to 0.69 by shifting the deflection center of the deflection coil toward the image (the mesh electrode). As apparent from FIG. 5, with the camera tube having such a structure as described in this embodiment, the resolution in the corners of the picture is much improved so that the uniformity in resolution over the picture is also much improved in comparison with the conventional camera tube. For example, in the case of an embodiment (the above mentioned test tube) with $Z_l/L = 0.50$ and $Z_D/L = 0.64$, the difference between the measured resolutions in the central area and corners of the picture could be reduced to about one quarter of that in the conventional camera tube.

As described above, according to this invention, the resolution of a camera tube with electrostatic focusing and magnetic deflection in the corners of the picture can be improved without degrading the resolution in the central area of the picture so that the uniformity in resolution over the picture can be improved.

What is claimed is:

1. In a camera tube with electrostatic focusing and magnetic deflection comprising a beam current control section having an electron beam limiting diaphragm, a focusing lens section including three cylindrical electrodes, a mesh electrode, and a magnetic deflection coil, the improvement in that the length of said magnetic deflection coil in the direction of the tube axis is 0.18–0.40 times the distance from said electron beam limiting diaphragm of said beam current control section to said mesh electrode.

2. In a camera tube with electrostatic focusing and magnetic deflection comprising a beam current control section having an electron beam limiting diaphragm, a focusing lens section including three cylindrical electrodes, a mesh electrode, and a magnetic deflection coil, the improvement in that the distance from said electron beam limiting diaphragm to the middle point of the length of said magnetic deflection coil along the tube axis is greater than 0.56 times the distance between said diaphragm and said mesh electrode and smaller than or equal to 0.7 times said distance between said diaphragm and said mesh electrode.

3. In a camera tube with electrostatic focusing and magnetic deflection comprising a beam current control section having an electron beam limiting diaphragm, a focusing lens section including three cylindrical electrodes, a mesh electrode, and a magnetic deflection coil, the improvement in that the distance from said electron beam limiting diaphragm to the middle point of the length along the tube axis of the middle one of said three cylindrical electrodes is greater than or equal to 0.47 times the distance from said diaphragm to said mesh electrode and smaller than 0.51 times said distance between said diaphragm and said mesh electrode.

* * * * *